US010123116B2

(12) United States Patent
Bjork et al.

(10) Patent No.: US 10,123,116 B2
(45) Date of Patent: Nov. 6, 2018

(54) LINEAR AND NON-LINEAR SPEAKER EXCURSION MODELING

(71) Applicant: Cirrus Logic International Semiconductor Ltd., Edinburgh (GB)

(72) Inventors: Ylva Ellen Maria Bjork, Solna (SE); Erik Vilhelm Lindahl, Stockholm (SE)

(73) Assignee: Cirrus Logic, Inc., Austin, TX (US)

( * ) Notice: Subject to any disclaimer, the term of this patent is extended or adjusted under 35 U.S.C. 154(b) by 0 days.

(21) Appl. No.: 15/498,831

(22) Filed: Apr. 27, 2017

(65) Prior Publication Data

US 2017/0318390 A1 Nov. 2, 2017

Related U.S. Application Data

(60) Provisional application No. 62/329,330, filed on Apr. 29, 2016.

(30) Foreign Application Priority Data

May 25, 2016 (GB) ..... 1609225.6

(51) Int. Cl.

| | |
|---|---|
| ***H04R 3/04*** | (2006.01) |
| ***G10L 21/038*** | (2013.01) |
| ***H04R 29/00*** | (2006.01) |
| ***H04R 3/00*** | (2006.01) |
| *H04R 3/08* | (2006.01) |

(52) U.S. Cl.

CPC ..... *H04R 3/04* (2013.01); *G10L 21/038* (2013.01); *H04R 3/007* (2013.01); *H04R 29/001* (2013.01); *H04R 3/08* (2013.01); *H04R 29/003* (2013.01); *H04R 2499/11* (2013.01)

(58) Field of Classification Search

CPC ..... H04R 3/04; H04R 3/08; H04R 29/001; H04R 2430/03; H04R 2499/11; H04R 3/007; H04R 29/003; G10L 21/038

USPC ..... 381/98, 55, 59, 94.9

See application file for complete search history.

(56) References Cited

U.S. PATENT DOCUMENTS

2015/0249889 A1* 9/2015 Iyer ..... H04R 3/08 381/98

FOREIGN PATENT DOCUMENTS

WO 2015143127 A1 9/2015

OTHER PUBLICATIONS

Gabbouj ("Modeling and Real-Time Auralization of Electrodynamic Loudspeaker Non-Linearities", ICASSP, 2004).*

Combined Search and Examination Report, Application No. GB1609225.6, dated Jul. 14, 2016.

* cited by examiner

*Primary Examiner* — Vivian Chin
*Assistant Examiner* — Douglas Suthers
(74) *Attorney, Agent, or Firm* — Jackson Walker L.L.P.

(57) ABSTRACT

A method for characterizing a loudspeaker comprises: filtering an input test signal by applying the inverse of a linear model describing an excursion of the loudspeaker in response to a given input signal, the linear model containing only linear terms; applying the filtered input test signal to the loudspeaker; measuring the excursion of the loudspeaker in response to the filtered input test signal; and, based on the measured excursion, determining one or more non-linear parameters for a non-linear model describing the excursion of the loudspeaker in response to a given input signal.

35 Claims, 9 Drawing Sheets

LINEAR AND NON-LINEAR SPEAKER EXCURSION MODELING

TECHNICAL FIELD

Examples of the present disclosure relate to methods and apparatus for characterizing loudspeakers, and to methods and apparatus for processing audio signals.

BACKGROUND

Loudspeakers were invented over 150 years ago, but the loudspeakers used today are still based on the same ideas. Traditionally, good sound quality has been obtained by using expensive materials in the loudspeakers and by allowing them to be big. However, nowadays loudspeakers are wanted in applications such as mobile phones and tablets where size and weight are limited and there is a desire to decrease production costs. Special small loudspeakers, known as micro loudspeakers or microspeakers, have been developed for this purpose. However, due to restrictions in size and manufacturing costs, their sound quality can be relatively poor.

One approach to overcoming this challenge is to use digital signal processing and active control to compensate for the poor quality. That is, a digital signal processor (DSP) may be used to adapt the input audio signal such that, once passed through the loudspeaker, a desired output is achieved. However, this requires accurate modelling of the loudspeaker.

SUMMARY

One particular aspect that has made characterization of loudspeakers difficult is the non-linear response of most systems. That is, an ideal, linear system will change the gain and the phase of the frequencies, without introducing additional frequency content. However, a non-linear system will introduce frequency content that was not present in the input signal (e.g., harmonics or intermodulation). Such non-linearities can be challenging to model and compensate for.

According to embodiments of the invention, there is provided a method for characterizing a loudspeaker, comprising: filtering an input test signal by applying the inverse of a linear model describing an excursion of the loudspeaker in response to a given input signal, the linear model containing only linear terms; applying the filtered input test signal to the loudspeaker; measuring the excursion of the loudspeaker in response to the filtered input test signal; and based on the measured excursion, determining one or more non-linear parameters for a non-linear model describing the excursion of the loudspeaker in response to a given input signal.

The method may be embodied by code stored on a computer-readable medium, configured such that, when the code is carried out by processing circuitry of an electronic device (such as a computer), the electronic device is configured to: generate a filtered input test signal by applying, to an input test signal, the inverse of a linear model describing an excursion of a loudspeaker in response to a given input signal, the linear model containing only linear terms; output the filtered input test signal to the loudspeaker; receive a signal indicating the measured excursion of the loudspeaker in response to the filtered input test signal; and based on the measured excursion, determine one or more non-linear parameters for a non-linear model describing the excursion of the loudspeaker in response to a given input signal.

The signal indicating the measured excursion may be received from one or more of a laser sensor, a microphone, an ultrasonic sensor and a radar sensor, for example.

In another aspect of the invention, there is provided an audio processor, for modifying an audio signal to be provided to a loudspeaker, the audio processor comprising: a first filter stage, for applying to an audio signal a linear model describing an excursion of the loudspeaker in response to a given input signal, the linear model containing only linear terms, and for generating one or more excursion signals; a plurality of second filters for receiving the one or more excursion signals, each of the second filters configured to apply to a respective one of a plurality of frequency bands in the one or more excursion signals the inverse of a model describing an excursion of the loudspeaker in response to a given input signal; and a combiner for combining the outputs of each of the plurality of second filters. At least a first one of the plurality of second filters applies the inverse of a non-linear model describing an excursion of the loudspeaker in response to a given input signal, the non-linear model comprising one or more non-linear parameters.

One or more of the non-linear parameters may be determined by the method described above.

BRIEF DESCRIPTION OF THE DRAWINGS

For a better understanding of examples of the present disclosure, and to show more clearly how the examples may be carried into effect, reference will now be made, by way of example only, to the following drawings in which.

DETAILED DESCRIPTION

Figure 1:
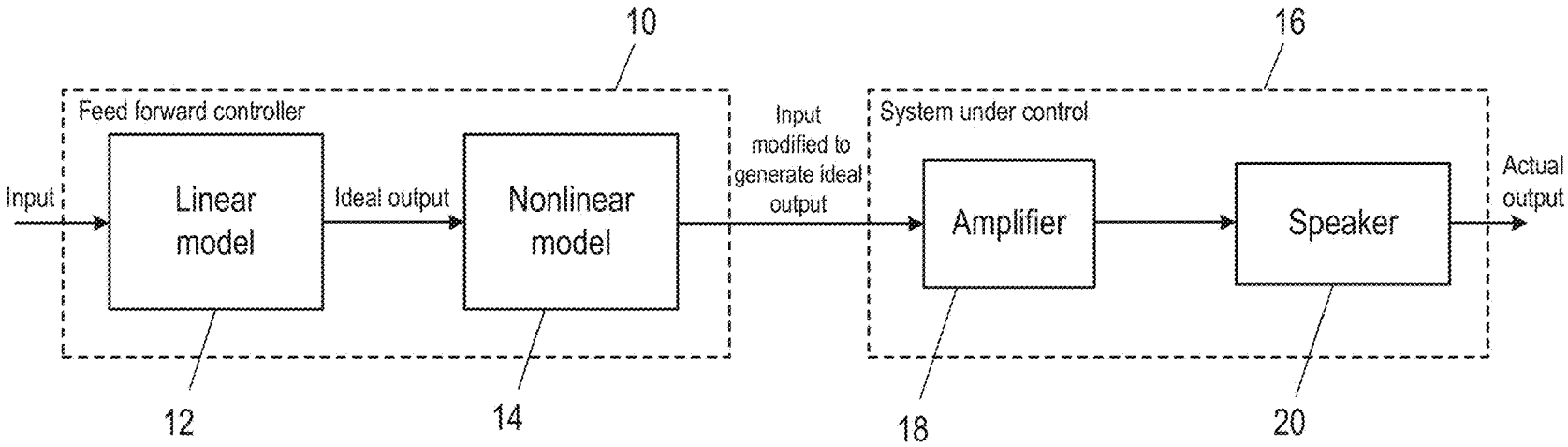
FIG. 1 is a schematic illustration of an audio processor and a loudspeaker system.

FIG. 1 is a schematic illustration of an audio processor 10 and a loudspeaker system 16. The audio processor 10 may be provided on an integrated circuit, or "chip", and may be, or may form part of, an audio codec.

The audio processor 10 is based on feed-forward control to modify an input audio signal and so produce a desired output of the loudspeaker system 16. An audio input signal is thus provided to the processor 10, and particularly to a module 12 that implements a linear model of the loudspeaker system 16. The linear model thus represents an "ideal" loudspeaker system, and this will be explored in greater detail below. The output of the module 12 is an "ideal" excursion signal representing a desired output signal from the loudspeaker system 16 (assuming the loudspeaker is itself ideal, i.e. linear). Note that the linear model implemented in the module 12 may be altered so as to add EQ to the audio signal.

However, real loudspeaker systems are not ideal, and on its own a linear model may not describe a real loudspeaker system sufficiently accurately. Thus the processor 10 comprises a second module 14 that implements a non-linear model of the loudspeaker system 16. The non-linear model may comprise the linear model implemented in the first module 12, with additional non-linear components. These non-linear components will be described in greater detail below. The second module 14 may output a signal that will achieve the ideal excursion signal output from the first module 12 when inputted to the real system 16. The second module 14 may apply an inverse of the non-linear model such that a more accurate replica of the original audio input signal is output from the system 16.

The output of the second module 14 (and of the audio processor 10) is an audio signal that is modified to take into account both the linear and the non-linear aspects of the loudspeaker system 16. This modified signal is provided to an amplifier 18 of the system 16, and the amplified signal is provided from the amplifier 18 to the loudspeaker 20. In an alternative embodiment, the amplifier 18 may also be part of the integrated circuit, "chip" or audio codec in which the processor 10 is embodied. Note that, as the amplifier 18 is located downstream of the modules 12, 14 in the signal path, the effects of the amplifier 18 are also taken into consideration in the linear and non-linear models applied in the modules 12, 14. In alternative configurations, the amplifier 18 may not have to be taken into account in those models and modules (e.g. it could be modelled separately).

The loudspeaker 20 may be conventional, and in one embodiment is a micro loudspeaker (or microspeaker). The loudspeaker 20 comprises a magnetic circuit that generates a magnetic field. A voice coil is placed in this field and when a current passes through it, a magnetic force is created which makes the voice coil move. A diaphragm is attached to the voice coil, and therefore this also moves and its displacement is denoted x. The diaphragm is attached to a frame by a suspension that acts to limit the displacement and bring the coil back to its original position when the force is reduced.

Those skilled in the art will appreciate that, in reality, the non-linear model will not be a perfect description of the system 16 and there are limitations in the input signal to the system (for example infinite power is not available). However, a more accurate characterization of the loudspeaker 16 may be obtained than hitherto possible.

A speaker is a time variant system, changing with factors such as temperature and ageing, so in order to keep the speaker from drifting away from the model, these changes may be tracked and passed to the feed forward controller.

Figure 2:
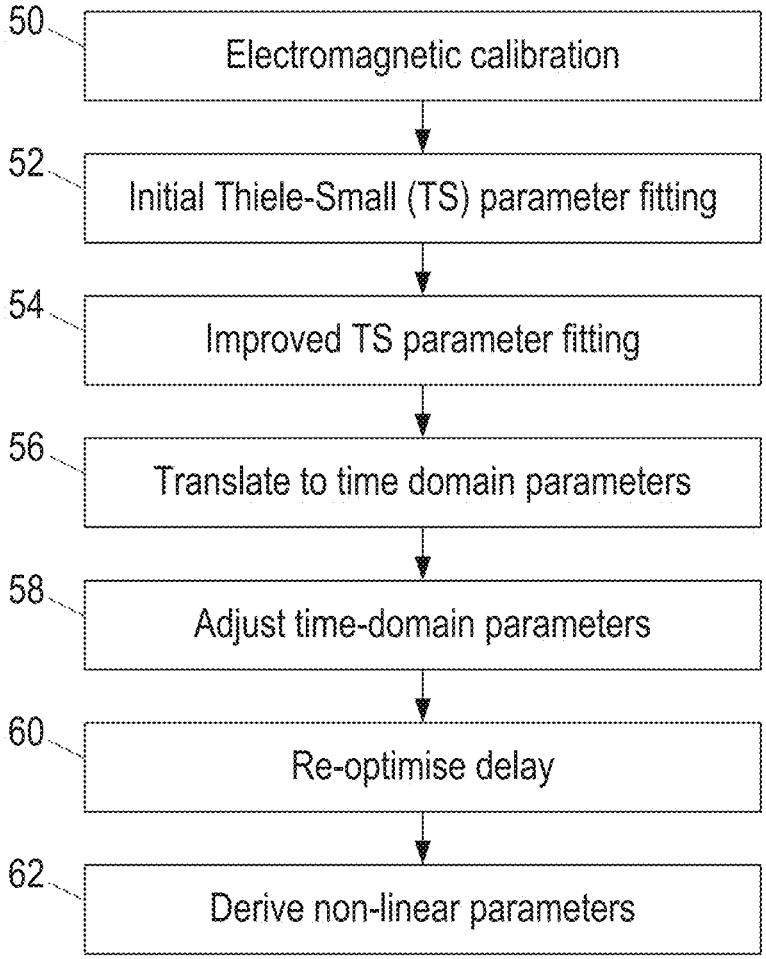
FIG. 2 is a flowchart of a method of characterizing a loudspeaker.

FIG. 2 is a flowchart of a method of characterizing a loudspeaker according to embodiments of the invention.

The method begins in step 50 in which the loudspeaker is calibrated. A suitable hardware set up for this process is shown in FIG. 3.

Figure 3:
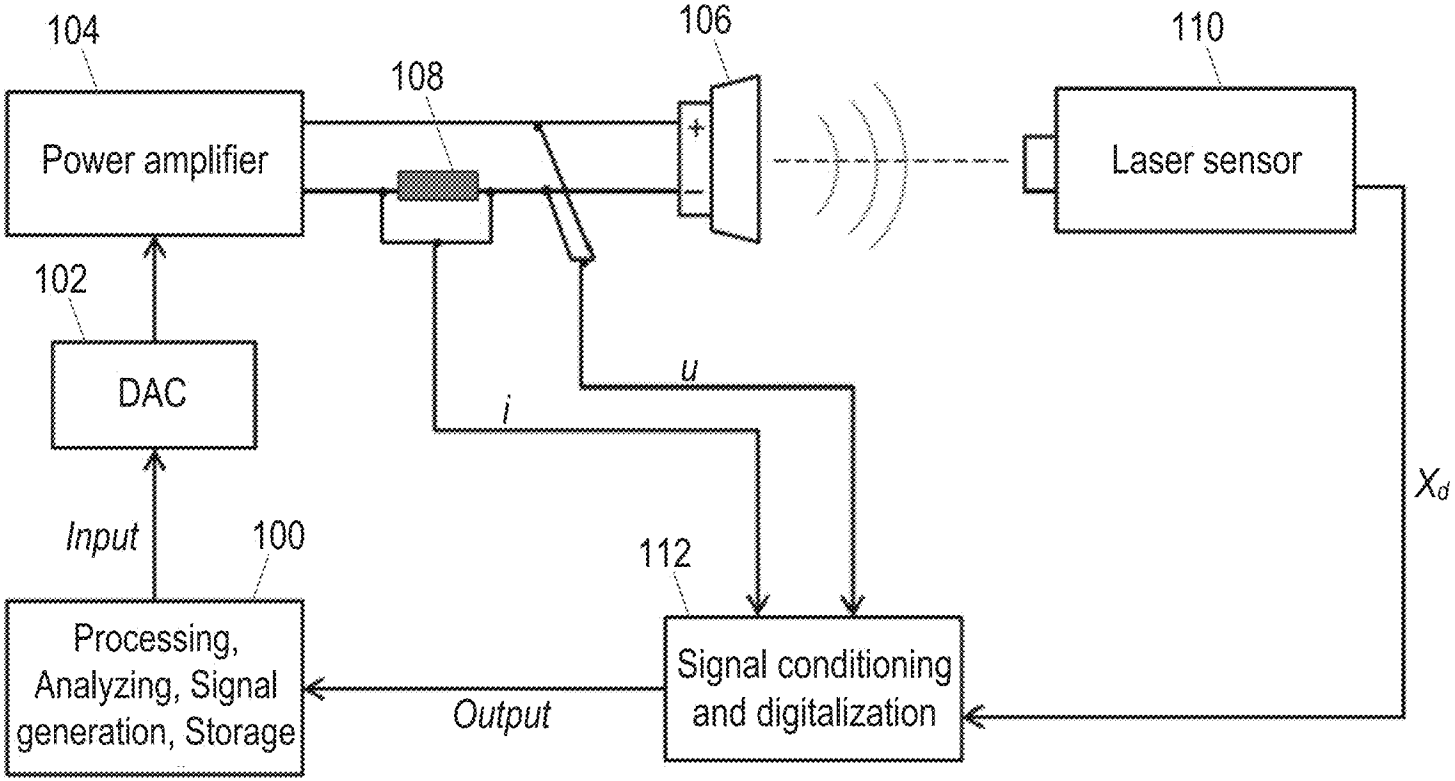
FIG. 3 is a schematic illustration of hardware suitable for carrying out the method of FIG. 2.

Referring to FIG. 3, a processor 100 provides an input signal to be output via the loudspeaker 106. The input signal is provided to a digital-to-analogue converter (DAC) 102 and converted to the analogue domain. The analogue signal is further provided to a power amplifier 104 where it is amplified. Note that, in alternative embodiments, the amplifier 104 may be a digital amplifier that would not require a separate DAC 102 as illustrated. The power amplifier 104 may be the same amplifier as provided with the loudspeaker 106 in use, such that the amplifier and the loudspeaker can be characterized in tandem. The amplified, differential output is provided to the loudspeaker 106 to be output. Note that the loudspeaker 106 may also be driven by a single pole in some embodiments.

A laser sensor 110 is positioned so that it can detect the excursion of the loudspeaker driver 106 in response to the input signal. The laser sensor 110 thus provides an output signal that is indicative of the loudspeaker excursion, $x_d$. This excursion signal is provided to an analogue-to-digital converter (ADC) 112, that in turn provides the signal (once digitized) to the processor 100. A nominal impedance 108 is placed in a signal path between the power amplifier 104 and the loudspeaker 106, such that the current i flowing to the loudspeaker 106 can be detected by detecting the voltage drop across the impedance 108. This current signal i is also passed to the ADC 112 for digitization before being provided to the processor 100. Alternative methods of measuring current may also be used. The differential voltage u applied to the loudspeaker 106 is also detected and digitized by the ADC 112 before being provided to the processor 100.

The processor 100 is thus able to determine the voltage, current and excursion of the loudspeaker 106 for a given input signal.

Those skilled in the art will be aware of many alternative hardware set ups that achieve the same outcome. The present disclosure is not limited to the hardware shown in FIG. 3. For example, instead of a laser sensor, ultrasonic or radar systems may be used to detect the excursion of the loudspeaker driver.

One goal of the characterization method of FIG. 2 is to model the Bl(x) nonlinearity. Bl(x) is known in the art as the "force factor" of the loudspeaker, as it is a measure of the force on the voice coil of the speaker for a given current through the voice coil. This nonlinearity is excursion-driven, meaning it can be approximated with a linear model if the excursion, x, is small enough. In order to properly model the system over the whole excursion range that will be used, it is useful to optimize the model to work over this range. In some embodiments, therefore, the speaker may be driven to its excursion limit as part of the characterization process, but without driving it too far in order not to damage the speaker. How far a certain signal will drive the speaker depends on both the speaker and the amplifier gain, so this has to be taken into account. Another hardware dependence is the delay in the loop and the time differences if signals are recorded on different devices. A calibration process is used to test the hardware.

In one embodiment, the calibration in step 50 of FIG. 2 is carried out as follows. The frequency and amplitude of the input signal are initially set to nominal values, sufficient to achieve at least a minimum excursion of the loudspeaker driver. For example, the minimum excursion may be 5% or 10% of the given maximum excursion (i.e. excursion limit) of the loudspeaker, or any other suitable value that ensures an acceptable signal-to-noise ratio. If the input signal is not sufficient to achieve that minimum excursion, then the amplitude is increased until the minimum excursion is reached. With the amplitude set at the nominal value, the frequency is swept across a range of values and the excursion measured. The resonant frequency $f_0$ can thus be determined (assuming the resonant frequency is within the range of frequencies swept) and the excursion at that frequency measured for the nominal amplitude. If the resonant frequency is not within the range swept, an approximate value for the resonant frequency may be input by a user.

With the frequency set to $f_0$, the amplitude of the input signal can then be swept from an initial low value to progressively higher values until a given threshold excursion is reached. The threshold excursion may be set to the excursion limit of the loudspeaker, or to a value within a predetermined distance of the excursion limit, e.g. 90% of the excursion limit.

With the excursion measured for each given input signal, the inverse amplifier gain may be calculated, i.e. unity divided by the gain between the digital output of the processor and the analogue output from the amplifier into the speaker. The approximate delay may also be calculated in some embodiments. The approximate delay may be determined by providing a given input signal (e.g. an impulse or white noise signal) and cross-correlating the output and the excursion signal to get the best match.

The calibration step 50 of FIG. 2 thus provides one or more of the following outputs:

- Approximate delay—An approximate number for the delay in terms of samples.
- Inverse gain—Unity divided by the gain between the digital output of the processor and the analogue output from the amplifier into the speaker.
- $f_0$—The resonance frequency of the speaker, detected from the maximum of the impedance curve.
- Output giving max excursion at $f_0$—The peak value of the digital output that is needed, with the current gain settings, to drive the speaker to a given excursion threshold (e.g. the excursion limit or to a value within a predetermined distance of the excursion limit) using a sine input signal at $f_0$.

The next step in the process shown in FIG. 2 is step 52, in which initial values of the Thiele-Small (TS) parameters for the loudspeaker are determined.

That is, to ensure that the model converges and to make this happen as soon as possible, it is desirable to use a good set of initial values for all parameters. One method for obtaining these initial values is given below. This method uses small excursions over which the response of the loudspeaker is essentially linear.

The hardware setup shown in FIG. 3 may again be employed to generate a data set by determining the excursion of the loudspeaker over a given range of frequencies. The amplitude of input signal may be set relatively low, as noted above. For example, the amplitude of the input signal may be set to 5% or 10% of the amplitude that gives maximum excursion at $f_0$, or any other suitable value that ensures an acceptable signal-to-noise ratio. The range of frequencies swept over may be from a relatively low frequency, below the resonant frequency (e.g. $0.2*f_0$), to a relatively high frequency, above the resonant frequency (e.g. $10*f_0$).

In alternative embodiments, measurements acquired during the calibration process in step 50 of FIG. 2 may be re-used.

The linear parameters of a loudspeaker can roughly be estimated from geometrical measurements of the impedance curve. This curve can be found by measuring the voltage and current over the voice coil while taking the measurements noted above. The signals are then Fourier transformed and the transform of the voltage is divided by the transform of the current. From this curve the maximum impedance $R_{max}$ and the voice coil resistance $R_e$ can be measured, along with the resonance frequency $f_0$ and the frequency at the minimum impedance $f_{min}$. $R_x$ is calculated according to:

$$r_0 = \frac{R_{max}}{R_e}$$

$$R_x = R_e\sqrt{r_0}$$

Two frequencies, $f_1$ and $f_2$, are determined by finding the frequencies at which the impedance has the value $R_x$ (on either side of the peak at $f_0$). From these values a number of intermediate parameters can be derived as $$Q_{ms} = \frac{f_0\sqrt{r_0}}{f_2 - f_1}$$

$$Q_{es} = \frac{Q_{ms}}{r_0 - 1}$$

$$Q_{ts} = \frac{Q_{ms}}{r_0}$$

where $Q_{ms}$ is the mechanical Q value of the loudspeaker driver at $f_0$, $Q_{es}$ is the electrical Q value of the loudspeaker driver at $f_0$, and $Q_{ts}$ is the total Q value of the loudspeaker driver at $f_0$. If the mass $M_{ms}$ (i.e. the mass of the diaphragm and coil, including acoustic load) is known, the linear parameters can now be calculated according to $$K_{ms} = M_{ms}(2\pi f_0)^2$$

$$R_{ms} = \frac{2\pi f_0 M_{ms}}{Q_{ms}}$$

$$Bl = \sqrt{\frac{2\pi f_0 R_e M_{ms}}{Q_{es}}}$$

$$L_e = \frac{(Bl)^2}{(2\pi f_{min})^2 M_{ms}}$$

where $K_{ms}$ is the mechanical stiffness of the driver suspension, $R_{ms}$ is the mechanical resistance of the driver suspension, Bl is the product of magnet field strength in the voice coil gap and the length of wire in the magnetic field (also known as the force factor), and $L_e$ is the voice coil inductance. If $M_{ms}$ is not known, it may be approximated according to the following equation:

$$M_{ms} = \frac{1}{(2\pi f_0)^3 H(0)^2 R_e Q_{es}}$$

where H(0) is the frequency transfer function at zero frequency (estimated by asymptotically approaching H(0) as $f \ll f_0$).

Thus step 52 of the method shown in FIG. 2 may output linear parameters for one or more of the following:

- $K_{ms}$—the mechanical stiffness of the driver suspension (the reciprocal of the mechanical compliance, $C_{ms}$).
- $R_{ms}$—the mechanical resistance of the driver suspension.
- Bl—the product of magnet field strength in the voice coil gap and the length of wire in the magnetic field (also known as the force factor).
- $L_e$—the voice coil inductance.
- $M_{ms}$—the mass of the diaphragm and coil, including acoustic load.

Once the initial values for the TS parameters have been obtained in step 52, they are improved in step 54 of FIG. 2 using one or more curve fitting methods.

In one embodiment, this consists of curve fitting the frequency response of the model in the frequency domain, first to the measured impedance curve and then to the measured force-factor curve. The impedance curve may be obtained, as above, by Fourier transforming the current and voltage signals and then dividing the transform of the voltage by the transform of the current (considering only the absolute magnitude, not the phase). The force-factor curve may be obtained by Fourier transforming the measured excursion and voltage signals and then dividing the transform of the excursion by the transform of the voltage again (considering only the absolute magnitude, not the phase).

The parameter set used in the models of step 54 is based on the TS parameters, but slightly re-arranged:

| | |
|---|---|
| Electrical Parameters | |
| $R_E$ | electrical voice coil resistance at DC |
| $L_E$ | voice coil inductance at low frequencies |
| $L_2$ | para-inductance at high frequencies |
| $R_2$ | resistance due to eddy currents |
| Derived Parameters | |
| $C_{MES} = M_{MS}/B^2l^2$ | electrical capacitance representing mechanical mass |
| $L_{CES} = C_{MS}\,B^2l^2$ | electrical inductance representing mechanical compliance |
| $R_{ES} = B^2l^2/R_{MS}$ | resistance due to mechanical losses |
| $f_s$ | driver resonance frequency |
| Mechanical Parameters | |
| $M_{MS}$ | mechanical mass of driver diaphragm |

For the impedance, the following model structure is used:

$$Z(s) = \frac{U(s)}{I(s)} = \frac{sL_{CES}}{s^2L_{CES}C_{MES} + s\frac{L_{CES}}{R_{ES}} + 1} + \frac{sL_2R_2}{sL_2 + R_2} + sL_E + R_E$$

where s is the Laplace variable, i.e. iω.

The second term may be excluded in some embodiments, since the model does not include eddy currents. These eddy currents are mainly influential on frequencies above $f_0$ and are not included in this version of the model.

Once the fitting to the impedance curve is done, all parameters except Bl are fixed and Bl is derived from curve fitting to the force-factor curve, using the following model (again with Zp(s)=0, and $L_2$ set to a nominal value, e.g. 1):

$$H_x(s) = \frac{X(s)}{U(s)} = \frac{V(s)Bls}{U(s)} \cdot \frac{1}{Bls} = \frac{Z_R}{Z_R + Z_P + sL_E + R_E} \cdot \frac{1}{Bls}$$

$$Z_R(s) = \frac{sL_{CES}}{s^2L_{CES}C_{MES} + s\frac{L_{CES}}{R_{ES}} + 1}$$

$$Z_P(s) = \frac{sL_2R_2}{sL_2 + R_2}.$$

The curve-fitting algorithms used may be any curve-fitting algorithm known in the art. For example, a LabView VI® algorithm called "Constrained Nonlinear Curve Fit VI", employing a Levenberg-Marquart algorithm based on least squares, may be used. In Matlab®, the "Isqcurvefit" function may be used. Those skilled in the art will appreciate that alternative known optimization algorithms may be employed without departing from the scope of the invention.

Figure 4:
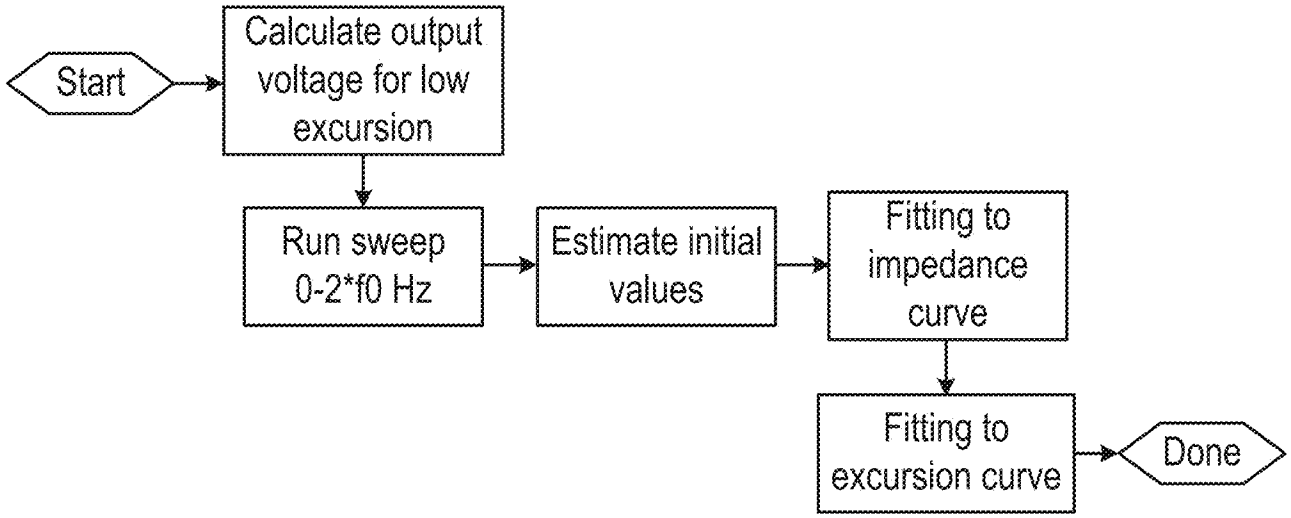
FIG. 4 is a flowchart of a method of determining linear parameters of a model characterizing a loudspeaker.

In some embodiments, the initial set of values obtained for the TS parameters in step 52 of FIG. 2 may be sufficient on their own, such that the optimization process of step 54 can be omitted. In other embodiments, a nominal set of values for the TS parameters may be used as inputs to the optimization methods of step 54, such that step 52 may be omitted. FIG. 4 shows the steps of a method 300 incorporating both steps 52 and 54 of FIG. 2 (i.e. initial estimation of TS parameters followed by optimization using one or more curve-fitting algorithms).

Since the control based on the values obtained in steps 52 and 54 of FIG. 2 may be implemented on a digital signal process (DSP), it may be more efficient to use a time-domain discrete model rather than a continuous frequency-domain model such as the classical Thiele-Small model. In step 56 of FIG. 2, therefore, the parameters obtained in steps 52 and 54 are translated to time-domain parameters. In step 58 of FIG. 2, those time-domain parameters are adjusted in a manner as described below. Those skilled in the art will appreciate that there are many ways of translating the parameters to the time domain. One method is described below.

The model structure is:

$$x_d[n] = \frac{\sigma_x Bl(x_d[n-1])}{R_e}u[u-1] + a_0\frac{\sigma_x Bl(x_d(n-1))}{R_e}u[n-2] - \left(\frac{\sigma_x Bl(x_d[n-1])^2}{R_e}\frac{2}{T_s} + a_1 + a_0 + \sigma_x k(x_d[n])\right)x_d[n-1] - \left(-\frac{\sigma_x Bl(x_d[n-1])^2}{R_e}\frac{2}{T_s} + a_0a_1 + a_2\right)x_d[n-2] - a_0a_2x_d[n-3]$$

Or the linear version of the model, k(x)=0 and Bl(x)=Bl(0).

The parameters in this model, $\sigma_x$, $a_0$, $a_1$ and $a_2$, may be correlated to the TS parameters. $a_0$ is a constant set to a positive value less than unity. $a_1$ and $a_2$ are feedback coefficients derived from the resonance frequency and damping ratio of the loudspeaker. $\sigma_x$ is the z-domain characteristic sensitivity calculated to make the gain of the discrete-time model match that of the continuous model. In one embodiment, this method is used to find the initial values for the discrete (i.e. time domain) model. A further estimation of the parameters (e.g. $\sigma_x$, $a_0$, $a_1$ and $a_2$, plus also Bl and $R_e$) is then done in the time domain to improve the fit of the model, as illustrated in FIG. 5.

Figure 5:
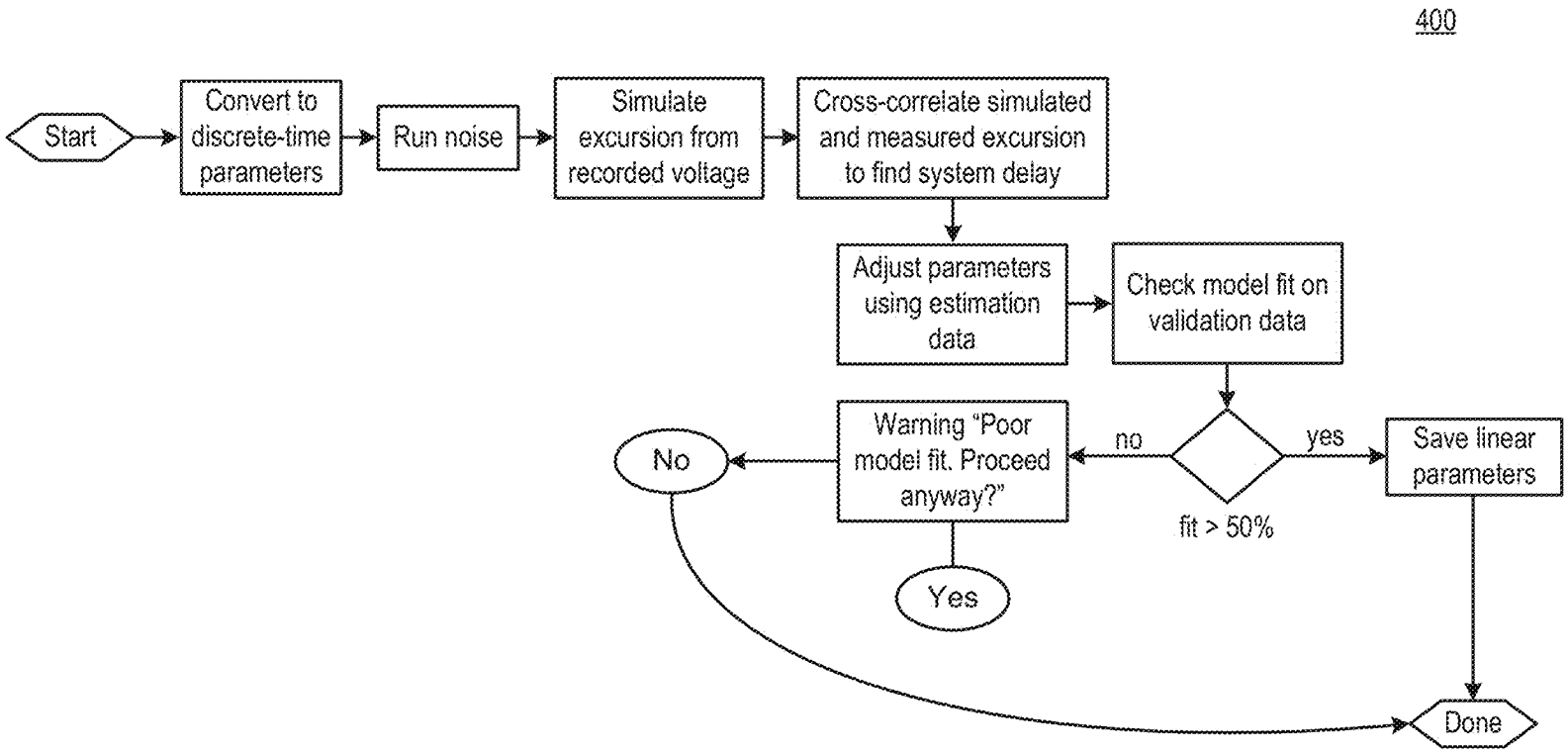
FIG. 5 is a flowchart of a method of determining discrete-time linear parameters of a model characterizing a loudspeaker.

The method 400 shown in FIG. 5 comprises a first step of converting the linear parameters output from step 54 of FIG. 2 into the parameters $\sigma_x$, $a_0$, $a_1$ and $a_2$ of the linear model outlined above. This may be achieved by matching the poles of the mechanical part of the system in the discrete and continuous models. The hardware shown in FIG. 3 is then employed to take further measurements of the loudspeaker 106 in order to adjust and improve those initial discrete linear parameters.

The stimuli used for improving the discrete linear parameters is band pass filtered white noise. That is, the input signals generated by the processor 100 comprise white noise signals that have been band-pass filtered. The amplitude of the input signals may be set relatively low, e.g. with a standard deviation set to 20% of the amplitude giving max excursion at $f_0$ (which is lowered even more by the action of the band-pass filter). The excursion at such amplitudes should be large enough to be well over the noise floor, but small enough to ensure the speaker is still in the small signal domain, where the nonlinear effects are very small.

The upper and lower cut-off frequencies of the band pass filter may be set to a relatively low frequency, lower than the resonant frequency, and a relatively high frequency, higher than or the same as the resonant frequency. In one embodiment, the lower cut-off frequency may be set to $f_0/3$ and the upper cut-off frequency may be set to $f_0$.

The voltage at the loudspeaker 106 is measured, and, together with the parameters determined in step 56 of FIG. 2, used to simulate the excursion of the loudspeaker 106. The actual excursion is also measured, e.g. with the laser 110, and these two signals (simulated and measured) can be cross-correlated in step 60 of FIG. 2 to determine the delay in the system (i.e. due to the loop delay in the laser 110). Note that the voltage and the excursion are not cross-correlated as any phase shift caused by the speaker 106 should be included in the model.

The time-domain parameters may be optimized using one or more curve-fitting algorithms to fit the simulated excursion to the measured excursion. The curve-fitting algorithms used may be any curve-fitting algorithm known in the art. For example, the LabView VI® algorithm "Constrained Nonlinear Curve Fit VI", employing a Levenberg-Marquart algorithm based on least squares, may again be used. In Matlab®, the "Isqcurvefit" function may again be used. Those skilled in the art will appreciate that alternative known optimization algorithms may be employed without departing from the scope of the invention.

The delay of the system (mismatch in laser and voltage measurements) has a large impact on time-domain measurements, but in the frequency domain it is manifested as a static (full frequency) phase shift. Therefore the delay does not affect the magnitude plots in the frequency domain. This means that the frequency domain model fitting (carried out in step 54 of FIG. 2) can be advantageously carried out independent of the system delay.

Since the nonlinear parameters extend the linear model, there is no use in looking for the nonlinearities unless the linear model fits reasonably well. To ensure that the linear model is good enough, in some embodiments, a validation is done.

For example, the hardware set up in FIG. 3 may be reused to obtain further measurements of the excursion of the loudspeaker in response to an input signal. In one embodiment, the input signals may again be band-pass filtered white noise. If the model fit (i.e the predicted excursion compared to the measured excursion) is below a threshold value (e.g. 50%) an error may be generated and the process interrupted before moving to nonlinear estimation.

Thus the output of steps 58 and 60 of FIG. 2 is a set of time-domain TS parameters (or TS-equivalent parameters) and an optimized system delay, i.e. a robust, linear model of the loudspeaker 106. In step 62 of FIG. 2, this model is extended with nonlinear parameters (keeping all the linear parameters fixed).

Figure 6:
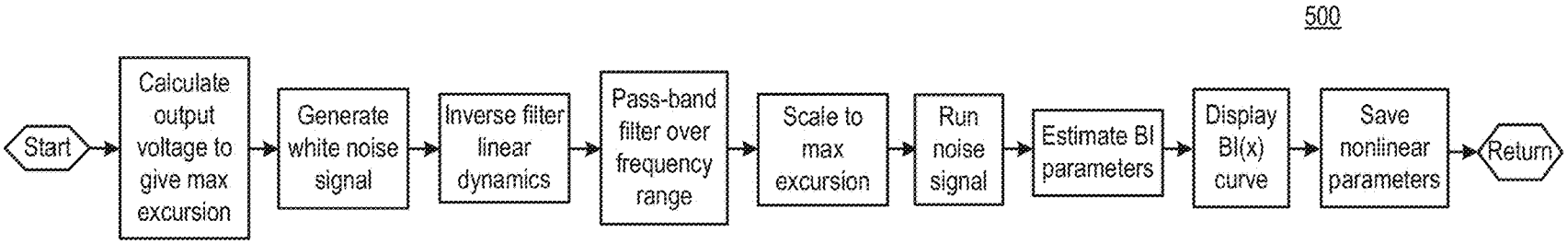
FIG. 6 is a flowchart of a method of determining non-linear parameters of a model characterizing a loudspeaker.

A method 500 for deriving non-linear parameters according to one embodiment is shown in FIG. 6.

The nonlinear model is an extension of the linear model where Bl(x) and k(x) are polynomials in x. Bl(x) is the force-factor, defined previously. k(x) is the non-linear parts of the parameter $K_{ms}$, i.e. $K_{ms}(x)-K_{ms}(0)$.

$$x_d[n] = \frac{\sigma_x Bl(x_d[n-1])}{R_e}u[n-1] + a_0\frac{\sigma_x Bl(x_d[n-1])}{R_e}u[n-2] -$$

-continued $$\left(\frac{\sigma_x Bl(x_d(n-1])^2}{R_e}\frac{2}{T_s} + a_1 + a_0 + \sigma_x k(x_d[n])\right)x_d[n-1] - \left(-\frac{\sigma_x Bl(x_d[n-1])^2}{R_e}\frac{2}{T_s} + a_0 a_1 + a_2\right)x_d[n-2] - a_0 a_2 x_d[n-3]$$

In some embodiments, only one of these parameters may be implemented in non-linear terms. For example, in one embodiment, only Bl(x) may be implemented, so k(x)=0. In such as embodiment, Bl(x) is a $5^{th}$ grade polynomial implemented as $$Bl(x)=Bl+Bl_0+Bl_1*x_{mm}+Bl_2*x_{mm}^2+Bl_3*x_{mm}^3+Bl_4*x_{mm}^4+Bl_4*x_{mm}^5$$

where $x_{mm}$=1000*x and Bl is the linear Bl parameter. The excursion is scaled in this embodiment to prevent problems when such a small number (x is measured in metres) is raised to multiple power. The same effect could be achieved by rescaling the gain to get x in mm. Alternatively, the curve-fitting algorithms may be capable of optimizing parameters in different orders of magnitude without such scaling.

Further measurements are taken with the set up shown in FIG. 3. In one embodiment, the loudspeaker 106 is again driven with band-pass filtered white noise. The upper and lower cut-off frequencies of the band pass filter may be set to a relatively low frequency, lower than the resonant frequency, and a relatively high frequency, higher than or the same as the resonant frequency. In one embodiment, the lower cut-off frequency may be set to $f_0/3$ and the upper cut-off frequency may be set to $f_0$.

Since the nonlinearities are manifested at high amplitude, the speaker 106 should be pushed to its limit (or close to its limit). To get the speaker 106 as close as possible to the limit, the noise signal is scaled so that the peak value matches the excursion limit. The noise signal is then inverse filtered through the linear model. The signal may be band-pass filtered at this point.

The behaviour of the loudspeaker 106 in response to such an input signal may be highly non-linear. That is, by passing the input signal through an inverse of the linear model, the linear aspects of the response of the loudspeaker should be removed leaving only the non-linear aspects. The excursion of the loudspeaker 106 can thus be measured (e.g. by the laser 110) and the Bl parameters estimated according to the non-linear model outlined above. The algorithm used to optimize the Bl parameters may be any standard optimization algorithm known in the art. For example, the Quasi-Newton BFGS method (Broyden-Fletcher-Goldfarb-Shanno) provided in the Matlab® optimization toolbox may be used for this purpose. The initial values for the non-linear parameters may be set to 0, random small values or more typical values (in order to improve at least the speed of the optimization algorithm).

Thus the output of step 62 of FIG. 2 is a set of non-linear parameters, e.g. for modelling the force-factor Bl(x). The method set out in FIG. 6 and step 62 of FIG. 2 may be extended to additional or different parameters without departing from the scope of the invention. For example, the parameter k(x) described above in the non-linear model may also be modelled as a polynomial and the parameters determined using substantially the same process as shown in FIG. 6.

Combined with the linear parameters determined in step 58 of FIG. 2, the non-linear parameters contain a complete model of the loudspeaker 106 under test. The model may be employed, for example, in the first and second modules 12, 14 described above with respect to FIG. 1.

For example, the first module 12 may apply the linear parameters determined in step 58 of FIG. 2 to an input signal, and so generate what may be termed an "ideal output", i.e. the output signal after it has passed through an ideal version of the loudspeaker 20. The linear model may be adapted as to add EQ to the signal if desired. The second module 12 may apply an inverse of the non-linear model (i.e. the linear parameters determined in step 58 of FIG. 2 and the non-linear parameters determined in step 62 of FIG. 2), and so generate a signal that is equivalent to the input signal (i.e. the input to the processor 10) but modified such that after passing through the real speaker 20 an ideal output is generated (by removal or reduction of the non-linear effects) . Note that the linear part of the model implemented in the second module 14 is not adapted to take into account EQ (else this would be substantially cancelled).

The audio input signal is thus adapted by the processor 10 so as to substantially linearize the output of the loudspeaker system 16.

Figure 7:
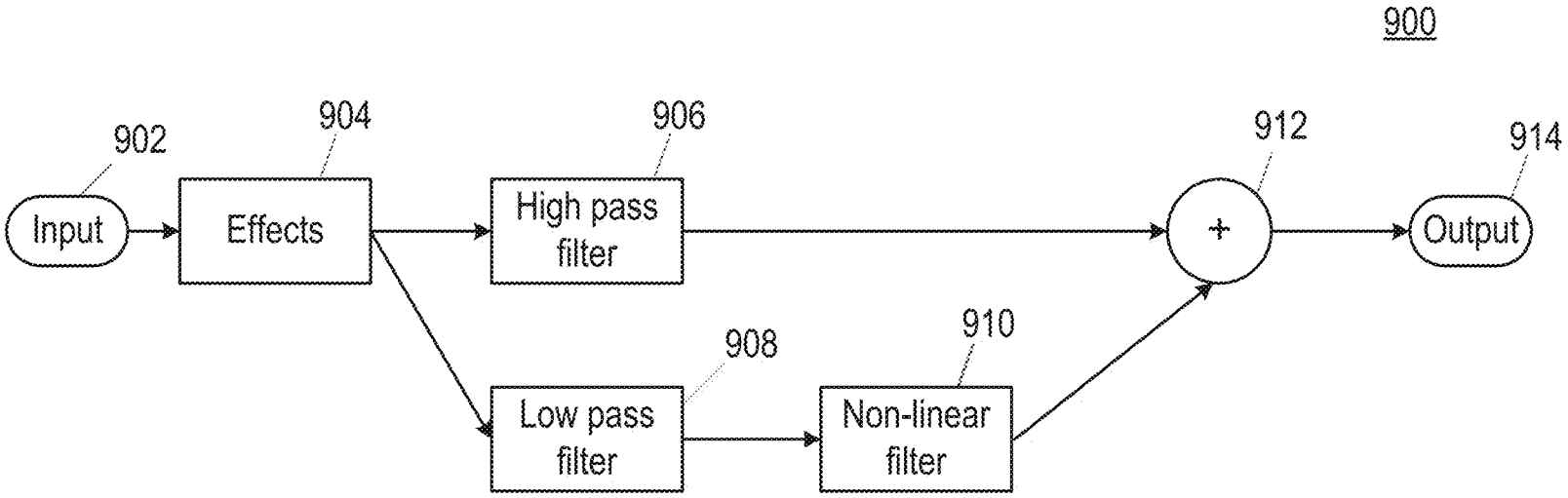
FIG. 7 is a schematic illustration of an audio processor.

FIG. 7 shows an audio processor 900 according to further embodiments of the invention. The audio processor 900 may be employed as the processor 10 shown in FIG. 1.

The processor 900 comprises an input 902 which receives an input signal to be filtered. The input signal may be an audio signal, which is to be modified so as to linearize the output of a loudspeaker to which the processor 900 is coupled.

The input signal is provided to an optional effects block 904 that is configured to alter the input signal so as to alter the speaker output in some desired way. For example, the block 904 may apply one or more of: parametric EQ, compressors, limiters, virtual base or virtual surround, stereo effects, etc. Speaker protection may also be applied by the block 904.

The output of the effects block 904 is split, with the signal on one branch being passed to a high-pass filter 906, and the signal on another branch being passed to a low-pass filter 908. Each of the filters may have a common cut-off frequency, i.e. with the high-pass filter 906 filtering out components of the signal below a certain frequency and the low-pass filter 908 filtering out components of the signal above a certain frequency.

The output of the low-pass filter 908 is then passed to a non-linear filter 910. The non-linear filter may implement a model of the loudspeaker system 16 that comprises non-linear terms. The non-linear terms may describe Bl(x), i.e. the force-factor of the loudspeaker 20. The model may further comprise linear terms.

In one embodiment, the non-linear filter 910 applies an inverse of the model of the loudspeaker system 16, such that the audio input signal received at the input 902 is modified so as to achieve a desired output once passed through the loudspeaker system 16. Note that a linear model may be applied to the audio input signal, e.g. prior to the effects block 904, substantially as shown in FIG. 1 (e.g. the action of the first module 12).

The outputs of the non-linear filter 910 and the high-pass filter 906 are combined in a combining element 912, and then provided to an output 914 for, e.g., provision to a loudspeaker system. Note that the high-frequency arm may comprise one or more delay elements to account for the delay introduced in the non-linear filter 910 (i.e. ensuring that components of the audio input signal are combined synchronously).

The processor 900 shown in FIG. 7 thus applies a non-linear model only to low-frequency components of the input signal. This embodiment therefore takes into account the possibility that the non-linear model may only model the non-linear parameters of the loudspeaker system sufficiently well over a limited range of frequencies, i.e. in the illustrated embodiment, at relatively low frequencies. If the non-linear model is not sufficiently accurate at other frequencies, it may be better simply not to apply the model to those frequencies.

The processor 900 shown in FIG. 7 may be extended or adapted so as to apply the non-linear model, or different non-linear models, to different frequency bands in the input signal. For example, the processor 900 may comprise more than two branches with corresponding filters (e.g. high-pass, low-pass and band-pass filters) designed to split the input signal into more than two frequency bands. A non-linear filter may be applied to one or more of the branches. If more than one non-linear filter is supplied in more than one corresponding branch, those non-linear filters may have the same or different parameters (such that the non-linear filter can be adapted specifically for each frequency band). One or more of the branches may not have any non-linear filters.

Figure 8:
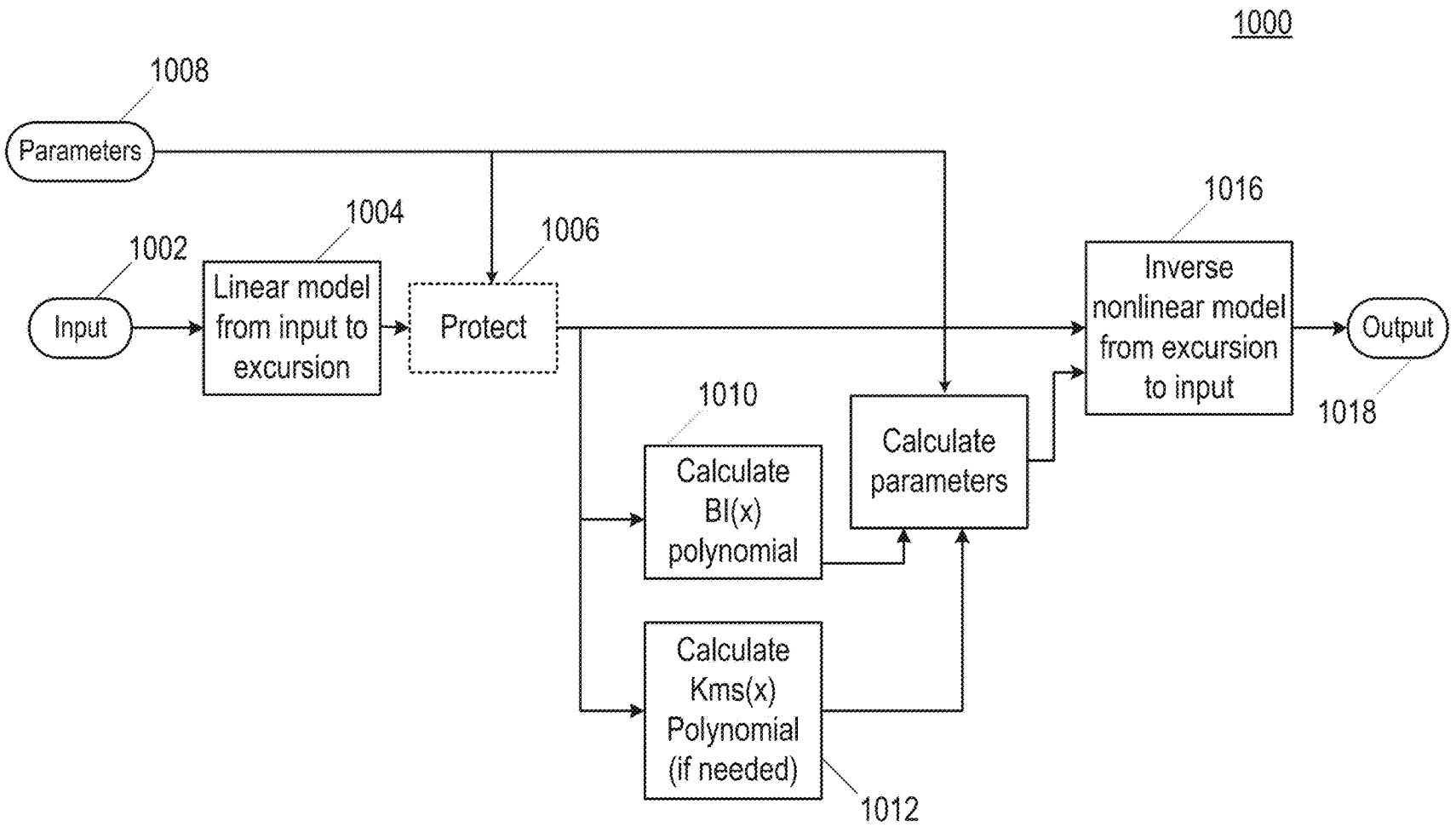
FIG. 8 is a schematic illustration of another audio processor.

FIG. 8 shows an example of a further audio processor 1000 according to embodiments of the invention. The audio processor 1000 may be employed as the audio processor 10 shown in FIG. 1.

The audio processor 1000 comprises an input 1002 which receives an input signal to be processed. The input signal may be an audio input signal, for example.

A linear filter 1004 receives the input signal and applies a linear model of the loudspeaker system to which the audio signal is to be provided. The input signal is thus converted from an audio signal into a signal indicating the excursion of the loudspeaker (if that loudspeaker was ideal, i.e. linear).

Optionally, the audio processor 1000 comprises a protect block 1006 that receives the output of the linear filter 1004 and modifies that signal so as to prevent over-excursion of the loudspeaker. That is, the output of the linear filter 1004 is a representation of the expected excursion of the loudspeaker. The loudspeaker will have an excursion limit above which the speaker should not be driven (else it would be damaged). The protect block 1006 may receive the expected excursion of the speaker, output from the linear filter 1004, and adapt the signal so as to prevent the loudspeaker being driven over its excursion limit. In practice, the loudspeaker may be driven to its limit or slightly over without significant damage being caused. The protect block 1006 may therefore ensure that the loudspeaker is not driven significantly over its excursion limit. The excursion limit may be provided by an input 1008 for receiving one or more parameters from other components of the system in which the processor 1000 is implemented. In an alternative embodiment, protection against over-excursion may be applied before the linear filter 1004 (or even in the input signal).

The output of the protect block 1006 is split into two or more branches. In the illustrated embodiment, the output is split into three branches.

One signal is passed to a block 1010 that is configured to calculate the (non-linear) force factor of the loudspeaker based on the calculated excursion data and, for example, the non-linear parameters determined above in step 62 of FIG. 2.

Another signal is passed to a block 1012 that is configured to calculate a different non-linear term of the non-linear model. For example, in the illustrated embodiment the block 1012 is configured to calculate $k_{ms}(x)$. In further embodiments, the block 1012 may calculated different terms (if provided for in the non-linear model), or additional branches may be supplied with separate blocks for calculating additional non-linear terms.

The outputs of the blocks 1010 and 1012 are provided to a further block 1014 that calculates filter coefficients based on the Bl(x) and/or $k_{ms}(x)$ values, and these are output to a non-linear filter 1016. The output of the protect block 1006 (i.e. one of the branches not provided with a parameter-calculating block) is also provided to the non-linear filter 1016, and this signal is filtered by the non-linear filter 1016 implementing at least the coefficients calculated in block 1014. In one embodiment, the filter 1016 implements an inverse of the loudspeaker model, additionally including the linear parameters. The filter 1016 thus converts the signal back from a signal representing an excursion to an audio signal. However, the signal is modified so as to substantially remove or reduce non-linear components of the loudspeaker response. The output of the filter 1016 is then provided to an output 1018 to be coupled to the loudspeaker.

Figure 9:
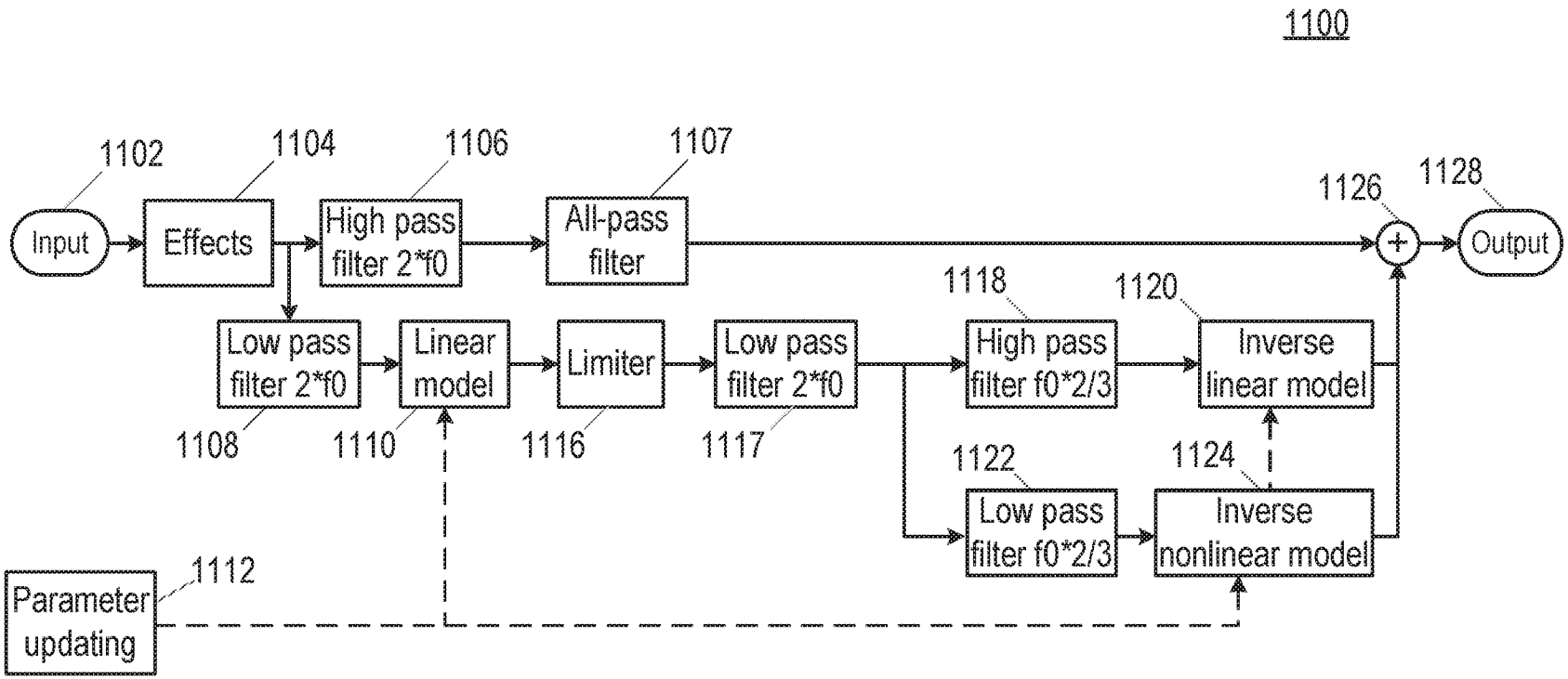
FIG. 9 is a schematic illustration of a further audio processor.

FIG. 9 shows an example of a further audio processor 1100 according to embodiments of the invention. The audio processor 1100 may be employed as the audio processor 10 shown in FIG. 1.

The audio processor 1100 comprises an input 1102 which receives an input signal to be processed. The input signal may be an audio input signal, for example.

The input signal is provided to an optional effects block 1104 that is configured to alter the input signal so as to alter the speaker output in some desired way. For example, the block 1104 may apply one or more of: parametric EQ, compressors, limiters, virtual base or virtual surround, stereo effects, etc.

The output of the effects block 1104 is split into two or more branches. A high-pass filter 1106 in the first branch filters out components of the signal below a certain frequency. A low-pass filter 1108 in the second branch filters out components of the signal above a certain frequency. The cut-off frequency in both cases may be set relatively high (i.e. high enough such that the excursion is below a threshold and does not have to be taken into account), e.g. above the resonant frequency of the loudspeaker 20. For example, the cut-off frequency may be set at $2*f_0$. The high-frequency components of the signal may be provided directly to a combining element 1126 without further processing (except for one or more delay elements and/or all-pass filters configured to achieve synchronicity between the various split signals). High-frequency components of audio signals typically do not have a significant impact on the excursion of the loudspeaker, and therefore removing those components from the processing in this way may act to advantageously lessen the processing intensity required in other branches.

The output of the low-pass filter 1108 is provided to a linear filter 1110 that implements a linear model of the loudspeaker 20. The parameters of the linear model (and thus the coefficients of the filter 1110) may be updated via a parameter updating module 1112 to take account of the ageing of the loudspeaker and/or changing temperature, for example. The parameter updating module 1112 receives suitable parameter inputs from one or more other components of the system, not illustrated, in which the processor 1100 is implemented (e.g. a temperature sensor, an applications processor, etc) and provides those parameters to at least the filter 1110.

The output of the filter 1110 is thus a representation of the excursion of the loudspeaker 20 as a result of the audio input signal, if that loudspeaker was ideal (i.e. had only linear terms). The output signal is provided to a limiter block 1116 that modifies the signal so as to prevent over-excursion of the loudspeaker 20. That is, the loudspeaker will have an excursion limit above which the speaker should not be driven (else it would be damaged). The limiter block 1116 may receive the expected excursion of the speaker, output from the linear filter 1110, and adapt the signal so as to prevent the loudspeaker being driven over its excursion limit. In practice, the loudspeaker may be driven to its limit or slightly over without significant damage being caused. The limiter block 1116 may therefore ensure that the loudspeaker is not driven significantly over its excursion limit.

The output of the limiter block 1116 is passed to a low-pass filter 1117 that removes and high-frequency noise introduced by the limiter block. The low-pass filter 1117 may therefore apply a cut-off frequency that is substantially the same as low-pass filter 1108, e.g. $2*f_0$.

The output of the low-pass filter 1117 is split into multiple branches, with each branch comprising one or more of an all-pass filter, a high-pass filter, a low-pass filter and a band-pass filter, such that the signal in each branch represents a different frequency band. In the illustrated embodiment, the output of the low-pass filter 1117 is split into two branches. One branch comprises a high-pass filter 1118, while the other branch comprises a low-pass filter 1122. Each of the filters 1118, 1122 has a common cut-off frequency such that the entire signal is represented by combining the signals on both branches. The cut-off frequencies may be chosen so as to define a frequency band or bands over which a non-linear model works well, and one or more frequency bands over which the non-linear model works less well or a different non-linear model works better. In the illustrated example, the cut-off frequency is chosen as $\frac{2}{3}*f_0$. At frequencies above this cut-off frequency, the non-linear model works relatively poorly; at frequencies below this cut-off frequency, the non-linear model works relatively well.

Therefore a non-linear filter 1124 is provided in the low-frequency branch, implementing the inverse of a non-linear model describing the excursion of the loudspeaker in response to a given input signal. The non-linear model, as described above, may comprise both linear terms and non-linear terms. A non-linear filter 1120 is provided in the high-frequency branch, implementing the inverse of a linear model describing the excursion of the loudspeaker in response to a given input signal. The linear model may comprise the linear terms of the non-linear model.

As with the linear filter 1110, the parameters implemented in the filters 1120 and 1124 may be updated with parameters received from the parameter updating module 1112. The non-linear parameters for the non-linear filter 1124 may be calculated on a sample-by-sample basis as described above using blocks 1010 and 1012 (with respect to FIG. 8).

The respective outputs of these filters 1120, 1124 are combined with the output of the high-pass filter 1106 in the combining element 1126, and provided to an output 1128 of the processor 1100 for further provision to the loudspeaker. The output of the high-pass filter 1106 is provided to the combining element 1126 via an all-pass filter 1107, to ensure that changes in phase are compensated for.

Embodiments of the invention thus provide methods and apparatus for measuring and characterizing a loudspeaker. In particular, the non-linear response of the loudspeaker can be determined using the methods and apparatus described above. Further, embodiments of the invention provide methods and apparatus for processing audio input signals so as to linearize the output of a given loudspeaker.

The skilled person will recognise that some aspects of the above-described apparatus and methods, for example the discovery and configuration methods may be embodied as processor control code, for example on a non-volatile carrier medium such as a disk, CD- or DVD-ROM, programmed memory such as read only memory (Firmware), or on a data carrier such as an optical or electrical signal carrier. For many applications embodiments of the invention will be implemented on a DSP (Digital Signal Processor), ASIC (Application Specific Integrated Circuit) or FPGA (Field Programmable Gate Array). Thus the code may comprise conventional program code or microcode or, for example code for setting up or controlling an ASIC or FPGA. The code may also comprise code for dynamically configuring re-configurable apparatus such as re-programmable logic gate arrays. Similarly the code may comprise code for a hardware description language such as Verilog™ or VHDL (Very high speed integrated circuit Hardware Description Language). As the skilled person will appreciate, the code may be distributed between a plurality of coupled components in communication with one another. Where appropriate, the embodiments may also be implemented using code running on a field-(re)programmable analogue array or similar device in order to configure analogue hardware.

Note that as used herein the term module shall be used to refer to a functional unit or block which may be implemented at least partly by dedicated hardware components such as custom defined circuitry and/or at least partly be implemented by one or more software processors or appropriate code running on a suitable general purpose processor or the like. A module may itself comprise other modules or functional units. A module may be provided by multiple components or sub-modules which need not be co-located and could be provided on different integrated circuits and/or running on different processors.

Embodiments may be implemented in an electronic device, especially a portable and/or battery powered electronic device such as a mobile telephone, an audio player, a video player, a PDA, a mobile computing platform such as a laptop computer or tablet and/or a games device for example.

It should be noted that the above-mentioned embodiments illustrate rather than limit the invention, and that those skilled in the art will be able to design many alternative embodiments without departing from the scope of the appended claims. The word "comprising" does not exclude the presence of elements or steps other than those listed in a claim, "a" or "an" does not exclude a plurality, and a single feature or other unit may fulfil the functions of several units recited in the claims. Any reference numerals or labels in the claims shall not be construed so as to limit their scope. Terms such as amplify or gain include possibly applying a scaling factor of less than unity to a signal.

The invention claimed is:

1. A method for characterizing a loudspeaker, comprising:

filtering an input test signal by applying the inverse of a linear model describing an excursion of the loudspeaker in response to a given input signal, the linear model containing only linear terms, wherein the input test signal has an amplitude that causes the loudspeaker to be driven to its excursion limit;

applying the filtered input test signal to the loudspeaker;

measuring the excursion of the loudspeaker in response to the filtered input test signal; and based on the measured excursion, determining one or more non-linear parameters for a non-linear model describing the excursion of the loudspeaker in response to a given input signal.

2. The method as set out in claim 1, wherein the input test signal comprises white noise.

3. The method as set out in claim 1, wherein the linear model additionally describes the excursion of the loudspeaker in response to a given input signal and a given amplification response.

4. The method as set out in claim 1, wherein the non-linear model additionally describes the excursion of the loudspeaker in response to a given input signal and a given amplification response.

5. The method as set out in claim 1, wherein the non-linear model additionally contains one or more linear terms.

6. The method as set out in claim 5, wherein the non-linear model comprises the linear model and the one or more non-linear parameters.

7. The method as set out in claim 1, wherein the one or more non-linear parameters comprise the force-factor of the loudspeaker.

8. The method as set out in claim 1, wherein the one or more non-linear parameters comprise the effective stiffness of a suspension of the loudspeaker.

9. The method as set out in claim 1, wherein the one or more non-linear parameters comprise Thiele-Small parameters.

10. The method as set out in claim 1, wherein the step of determining one or more non-linear parameters comprises:

determining initial values for the one or more non-linear parameters; and applying an iterative algorithm to the initial values until the one or more non-linear parameters of the non-linear model predict the measured excursion of the loudspeaker.

11. The method as set out in claim 10, wherein the initial values are zero.

12. The method as set out in claim 10, wherein the iterative algorithm comprises a Broyden-Fletcher-Goldfarb-Shanno optimization algorithm.

13. The method as set out in claim 1, wherein the step of measuring the excursion of the loudspeaker comprises measuring the excursion of the loudspeaker with one or more of: a laser sensor, a microphone, an ultrasonic sensor, and a radar sensor.

14. The method as set out in claim 1, further comprising:

applying a second input test signal to the loudspeaker;

measuring the excursion of the loudspeaker in response to the second input test signal; and based on the measured excursion of the loudspeaker in response to the second input test signal, determining one or more linear terms of the linear model.

15. The method as set out in claim 14, wherein the second input test signal has an amplitude such that the excursion of the loudspeaker in response to the second input test signal is below a threshold excursion.

16. The method as set out in claim 15, wherein the threshold excursion is a value less than 50% of the excursion limit of the loudspeaker.

17. The method as set out in claim 16, wherein the threshold excursion is a value less than 20% of the excursion limit of the loudspeaker.

18. The method as set out in claim 14, wherein the step of determining one or more linear terms of the linear model comprises:

determining one or more frequency-domain linear terms; and converting the one or more frequency-domain linear terms to the time domain, wherein the one or more linear terms of the linear model comprise one or more linear terms in the time domain.

19. A non-transitory computer-readable medium comprising code configured to, when executed by processing circuitry of an electronic system, cause the electronic system to:

generate a filtered input test signal by applying, to an input test signal, the inverse of a linear model describing an excursion of a loudspeaker in response to a given input signal, the linear model containing only linear terms, wherein the input test signal has an amplitude that causes the loudspeaker to be driven to its excursion limit;

output the filtered input test signal to the loudspeaker;

receive a signal indicating the measured excursion of the loudspeaker in response to the filtered input test signal; and based on the measured excursion, determine one or more non-linear parameters for a non-linear model describing the excursion of the loudspeaker in response to a given input signal.

20. The non-transitory computer-readable medium as set out in claim 19, wherein the input test signal comprises white noise.

21. The non-transitory computer-readable medium as set out in claim 19, wherein the linear model additionally describes the excursion of the loudspeaker in response to a given input signal and a given amplification response.

22. The non-transitory computer-readable medium as set out in claim 19, wherein the non-linear model additionally describes the excursion of the loudspeaker in response to a given input signal and a given amplification response.

23. The non-transitory computer-readable medium as set out in claim 19, wherein the non-linear model additionally contains one or more linear terms.

24. The non-transitory computer-readable medium as set out in claim 23, wherein the non-linear model comprises the linear model and the one or more non-linear parameters.

25. The non-transitory computer-readable medium as set out in claim 19, wherein the one or more non-linear parameters comprise the force-factor of the loudspeaker.

26. The non-transitory computer-readable medium as set out in claim 19, wherein the one or more non-linear parameters comprise the effective stiffness of a suspension of the loudspeaker.

27. The non-transitory computer-readable medium as set out in claim 19, wherein the one or more non-linear parameters comprise Thiele-Small parameters.

28. The non-transitory computer-readable medium as set out in claim 19, wherein the code configured to cause the electronic system to determine one or more non-linear parameters comprises code configured to cause the electronic system to:

determine initial values for the one or more non-linear parameters; and apply an iterative algorithm to the initial values until the one or more non-linear parameters of the non-linear model predict the measured excursion of the loudspeaker.

29. The non-transitory computer-readable medium as set out in claim 28, wherein the initial values are zero.

30. The non-transitory computer-readable medium as set out in claim 28, wherein the iterative algorithm comprises a Broyden-Fletcher-Goldfarb-Shanno optimization algorithm.

31. The non-transitory computer-readable medium as set out in claim 19, further comprising code configured to cause the electronic system to:

output a second input test signal to the loudspeaker;

receive a signal indicating the measured excursion of the loudspeaker in response to the second input test signal; and based on the measured excursion of the loudspeaker in response to the second input test signal, determine one or more linear terms of the linear model.

32. The non-transitory computer-readable medium as set out in claim 31, wherein the second input test signal has an amplitude such that the excursion of the loudspeaker in response to the second input test signal is below a threshold excursion.

33. The non-transitory computer-readable medium as set out in claim 32, wherein the threshold excursion is a value less than 50% of the excursion limit of the loudspeaker.

34. The non-transitory computer-readable medium as set out in claim 33, wherein the threshold excursion is a value less than 20% of the excursion limit of the loudspeaker.

35. The non-transitory computer-readable medium as set out in claim 31, wherein the code configured to cause the electronic system to determine one or more linear parameters comprises code configured to cause the electronic system to:

determine one or more frequency-domain linear terms; and convert the one or more frequency-domain linear terms to the time domain, wherein the one or more linear terms of the linear model comprise one or more linear terms in the time domain.

* * * * *